US010258154B2

(12) United States Patent
Matuszewski

(10) Patent No.: US 10,258,154 B2
(45) Date of Patent: Apr. 16, 2019

(54) ADJUSTABLE ORGANIZATIONAL SYSTEM FOR SINGLE AND MULTI-TIERED CABINETS

(71) Applicant: David L. Matuszewski, Buffalo, NY (US)

(72) Inventor: David L. Matuszewski, Buffalo, NY (US)

( * ) Notice: Subject to any disclaimer, the term of this patent is extended or adjusted under 35 U.S.C. 154(b) by 5 days.

(21) Appl. No.: 15/827,720

(22) Filed: Nov. 30, 2017

(65) Prior Publication Data

US 2018/0146780 A1 May 31, 2018

Related U.S. Application Data

(60) Provisional application No. 62/428,202, filed on Nov. 30, 2016.

(51) Int. Cl.

| | |
|---|---|
| ***A47B 67/04*** | (2006.01) |
| ***B65D 63/10*** | (2006.01) |
| ***A47B 96/14*** | (2006.01) |
| *A47F 7/00* | (2006.01) |
| *A47B 57/58* | (2006.01) |
| *A47B 67/02* | (2006.01) |
| *A47B 88/969* | (2017.01) |

(52) U.S. Cl.

CPC ..... *A47B 67/04* (2013.01); *A47B 96/14* (2013.01); *B65D 63/10* (2013.01); *A47B 57/58* (2013.01); *A47B 67/02* (2013.01); *A47B 88/969* (2017.01); *A47F 7/0014* (2013.01)

(58) Field of Classification Search

CPC .... B65D 65/10; B65D 73/0014; B65D 63/10; A47B 96/14; A47B 67/04; A47B 73/00; A47B 73/008; A47B 81/007; A47B 57/58; A47B 88/969; A47B 67/02; A45C 13/02; A47F 7/283; A47F 7/28; A47F 81/005; A47F 7/0035; A47F 7/0021; A47F 7/0014; A47J 47/16; A47L 13/512; A47K 1/09

USPC ..... 312/209; 206/495, 477, 478, 481; 211/75, 74, 65, 85.18, 85.22

See application file for complete search history.

(56) References Cited

U.S. PATENT DOCUMENTS 2,081,216 A * 5/1937 Bosserman ..... A47F 7/175 211/44

2,149,615 A * 3/1939 McElwee ..... A61J 9/0684 211/74

(Continued)

*Primary Examiner* — Hiwot E Tefera

(74) *Attorney, Agent, or Firm* — Vincent G. LoTempio; Kloss, Stenger & LoTempio; David Stephenson

(57) ABSTRACT

An adjustable organizational system for single and multi-tiered cabinets, shelves, and drawers. The system segregates items inside a cabinet on different tiers of shelves, and then groups the segregated items on each shelf into size-dependent groups through length adjustable straps that have adjustable heights and lengths. Multiple groups of items can be segregated on the same shelf through positional and height adjustment of the straps. Straps are defined by a pair of free ends that are secured to the walls of cabinet to enable grouping of items based on the size, shape, and function of the item. Strap adjustment members detachably fasten free ends of straps into cabinet walls. Strap adjustment members comprise a side mounting block, a stud, and a retaining nut. Nut extends and retracts relative to stud and cabinet walls to adjust length and position of straps relative to adjacent straps and cabinet walls.

19 Claims, 5 Drawing Sheets

(56) References Cited

U.S. PATENT DOCUMENTS

| | | | | | |
|---|---|---|---|---|---|
| 3,877,580 | A * | 4/1975 | Hammar | A47B 57/581 | 108/27 |
| 3,894,707 | A * | 7/1975 | Heard | F16B 2/08 | 248/225.11 |
| 4,094,487 | A * | 6/1978 | Heard | G09F 7/18 | 248/230.9 |
| 5,131,732 | A | 7/1992 | Lane et al. | | |
| 5,139,322 | A | 8/1992 | Aisley | | |
| 5,242,063 | A * | 9/1993 | Ericksen | A47K 3/281 | 211/65 |
| 5,273,168 | A * | 12/1993 | Stevens | A47F 7/285 | 211/132.1 |
| 5,462,250 | A * | 10/1995 | Fells | B60T 17/221 | 248/349.1 |
| 5,524,980 | A | 6/1996 | Carter et al. | | |
| 5,632,543 | A * | 5/1997 | McGrath | F25D 23/063 | 220/592.09 |
| 5,671,849 | A | 9/1997 | Bacon | | |
| 5,833,095 | A | 11/1998 | Russell et al. | | |
| 6,454,234 | B1 * | 9/2002 | Westbrook | F16M 11/041 | 248/317 |
| 6,641,096 | B2 | 11/2003 | Johansson et al. | | |
| 7,093,807 | B2 | 8/2006 | Wylie | | |
| 2003/0029977 | A1 * | 2/2003 | Kim | A47B 81/007 | 248/230.8 |
| 2005/0163563 | A1 * | 7/2005 | Joncourt | F16B 7/0413 | 403/373 |
| 2006/0278794 | A1 * | 12/2006 | Rast | A47B 21/06 | 248/346.01 |
| 2016/0082829 | A1 * | 3/2016 | Hummel | F16B 2/08 | 248/315 |

* cited by examiner

ADJUSTABLE ORGANIZATIONAL SYSTEM FOR SINGLE AND MULTI-TIERED CABINETS

CROSS REFERENCE OF RELATED APPLICATIONS

This application claims the benefits of U.S. provisional application No. 62/428,202, filed Nov. 30, 2016 and entitled SINGLE AND MULTI-TIERED CABINET ORGANIZATION SYSTEM, which provisional application is incorporated by reference herein in its entirety.

FIELD OF THE INVENTION

The present invention relates generally to an adjustable organizational system for single and multi-tiered cabinets, drawers, and other organizing shelving fixtures. More so, the organizational system segregates a plurality of items inside a cabinet on shelves, and then groups the segregated items on each shelf into size-dependent tiers of groups through use of length adjustable, resilient straps that can be length adjusted with a plurality of strap adjustment members; whereby, multiple groups and tiers of items can be segregated on the same shelf through positional and height adjustment of the straps.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a shelf is a flat horizontal surface used for display and storage. Often, shelves include a flat horizontal plane which is used in a home, business, store, or elsewhere to hold items that are being displayed, stored, or offered for sale. The shelf is often raised off the ground and usually anchored/supported on its shorter length sides by brackets, columns, or pillars.

In many instances, shelves are used to retain multiple items on a flat surface. However, the items positioned on the shelf may be scattered along the flat surface; and thereby difficult to find. Further, in cases of storing items in moving vehicles, such as recreational vehicles and boats, the items can fall off the shelf when the vehicle leans in a direction, accelerates, or decelerates suddenly.

Often, shelving systems lack adjustability, aesthetics, flexibility of use, and functionality; thus limiting the consumer and forcing the user to make permanent storage choices. Further, many shelving systems require significant assembly, which users may not be competent in assembling. Often the shelf assembly is not intuitive and requires detailed instructions and tools, along with mechanical ability to read and follow instructions.

Other proposals have involved shelving systems. The problem with these shelving systems is that they do not organize the items to create easy to find groups or tiers of items. Also, the items are not securely retained on the shelf. Even though the above cited shelving systems meet some of the needs of the market, an adjustable organizational system for single and multi-tiered cabinets that segregates items inside a cabinet, and on different tiers of shelves, and further segregates the items into size-dependent groups through use of length adjustable, resilient straps is still desired.

SUMMARY

Illustrative embodiments of the disclosure are generally directed to an adjustable organizational system for single and multi-tiered cabinets. The organizational system is operable with single-tiered, double-tiered, triple-tiered, and multi-tiered cabinets, shelves, drawers, or other organizing fixtures. The organizational system is configured to segregate a plurality of items inside a cabinet, and on different tiers of shelves. The organizational system may then be used to group the segregated items into size-dependent groups through use of a plurality of resilient, length adjustable straps. The straps help retain at least one item along the back wall, the sidewalls, and the bottom wall of the cabinet. The straps can be fastened to the cabinet to achieve different lengths. In this manner, multiple groups of items can be segregated into desired groups and tiers on the same shelf through positional and height adjustment of the straps.

System further provides a cabinet that is defined by a back wall, a pair of sidewalls, and a bottom wall. Cabinet is configured to store and support a plurality of items in an organized, segregated arrangement, described below. The system further comprises at least one shelf extending between the pair of sidewalls of the cabinet. The shelf may be flat and horizontal.

System further comprises a plurality of straps defined by at least one slot and a pair of free ends. The slots enhance the resiliency of the straps. The slots are disposed in a linear, spaced-apart relationship. The straps extend across the back wall, the pair of sidewalls, and the bottom wall. The straps are further being defined by a resilient configuration enabling extension and retraction of the straps relative to the back wall, the sidewalls, and the bottom wall of the cabinet. In this manner, the straps help retain at least one item along the back wall, the sidewalls, and the bottom wall of the cabinet.

System further provides a plurality of strap adjustment members for adjusting the length and position of straps. The strap adjustment members comprise a side mounting block, a stud, and a retaining nut, the strap adjustment members detachably fastening the free ends of the straps together, the strap adjustment members further detachably fastening the free ends of the straps to the back wall, the sidewalls, and the bottom wall of the cabinet.

The nut may be rotatably displaced along the length of the stud to adjust the length of the straps. In this manner, rotating the nut relative to the side mounting block creates a gap between the straps and the back wall, the sidewalls, and the bottom wall of the cabinet that allows for placement of the items.

In another aspect, the cabinet may include, without limitation, a recreational vehicle cabinet, a medicine cabinet, and a kitchen cabinet.

In another aspect, the pluralities of shelves are configured to support a plurality of items, which may include, without limitation, a hygiene container, a medicine container, a shaving device, an electrical device, a tool, wiring, and a food item.

In another aspect, the slots in the straps are disposed in a linear, spaced-apart relationship so as to enhance.

In another aspect, the straps are generally resilient and flat.

In another aspect, the strap adjusting members comprise a fixed threaded bolt and adjustable nuts.

One objective of the present invention, is to organize hygienic and medicinal items in, but not limited to, a medicine cabinet/shelving/drawer along individual or stacked shelves or drawers, and to separate groups on each shelf or drawer.

Another objective of the present invention is to provide a flexible strap that extends across the items to help restrain the items against the back wall of the cabinet in an organized manner.

Another objective of the present invention is to provide multiple strap adjusting members that can be positioned to accommodate different size-dependent items across the back wall and/or sidewalls of the cabinet.

Another objective of the present invention is to provide multiple mounting blocks that are easy to position anywhere along the back walls of a medicine cabinet/shelf/drawer.

Another objective of the present invention is to provide versatile length adjustable straps that exhibit sufficient the elasticity for flexibility; and slots through the straps for accommodating size-dependent items.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 4A illustrates a triple-tier strap adjustment member, FIG. 4B illustrates a double-tier strap adjustment member, FIG. 4C illustrates a single-tier strap adjustment member, and FIG. 4D illustrates a strap adjustment member with a two-sided adhesive, in accordance with an embodiment of the present invention; FIG. 5A illustrates a triple tiered organizational system with a central strap connecting at the free ends to side straps, and FIG. 5B illustrates a connector stud joining two nuts, in accordance with an embodiment of the present invention.

Like reference numerals refer to like parts throughout the various views of the drawings.

DETAILED DESCRIPTION OF THE INVENTION

Figure 1:
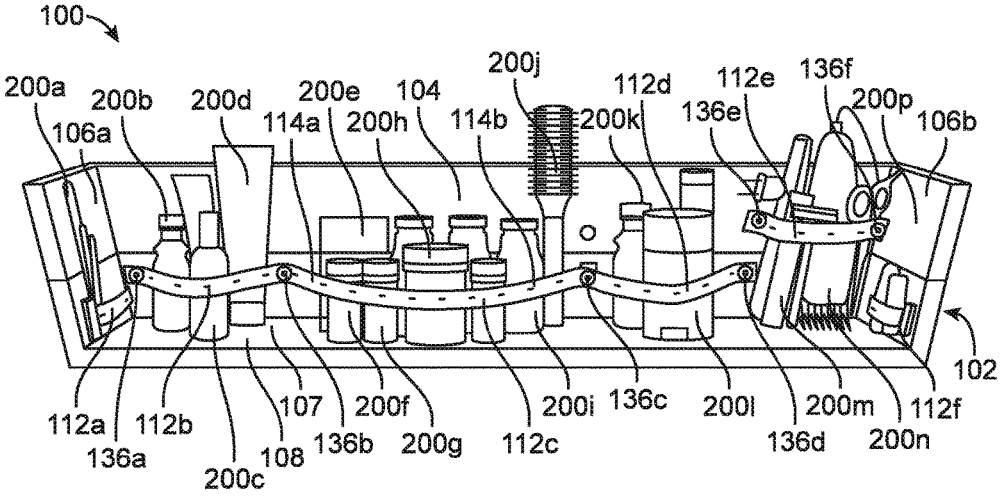
FIG. 1 illustrates a perspective exemplary view of a single tiered adjustable organizational system for single and multi-tiered cabinets, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

FIG. 1 illustrates an exemplary view of an adjustable organizational system 100 for a single-tiered cabinet, shelves, drawers, and organizing fixtures. Adjustable organizational system 100, hereafter, "system 100" works to segregate a plurality of items 200*a-p* inside a cabinet 102 on shelves 110, and then group the segregated items 200*a-p* on each shelf 110 into size-dependent groups and tiers through use of resilient, length adjustable straps 112*a-f* that can easily be length adjusted relative to the cabinet walls with strap adjustment members 136*a-f*.

System 100 is unique in that multiple groups and tiers of items can be segregated on the same shelf 110, or bottom wall 107 of the cabinet 102 through positional and height adjustment of the straps 112*a-f*. In one non-limiting embodiment, straps 112*a*, 112*b*, 112*c*, 112*d*, 112*e*, 112*f* are defined by a pair of free ends 114*a*, 114*b* that are secured to the cabinet walls 104, 106*a*, 106*b*, 107, so as to enable grouping of items 200*a-p* into desired groups and tiers, based on the size, shape, and function of the items 200*a-p*.

Strap adjustment members 136*a-f* are operable to detachably fasten free ends 114*a*, 114*b* of straps 112*a-f* into cabinet walls 104, 106*a-b*, 107. Strap adjustment members 136*a-f* comprise a side mounting block 115*a-c*, a stud 116*a-f*, and a retaining nut 118*a-f*. Nut 118*a-f* extends and retracts relative to stud 116*a-f* and cabinet walls 104, 106*a-b*, 107 to adjust the length and position of straps 112*a-f* relative to cabinet walls 104, 106*a-b*, 107, so as to enable size dependent grouping of items 200*a-p* on the same shelf 110 or cabinet wall 104, 106*a-b*, 107.

Figure 2:
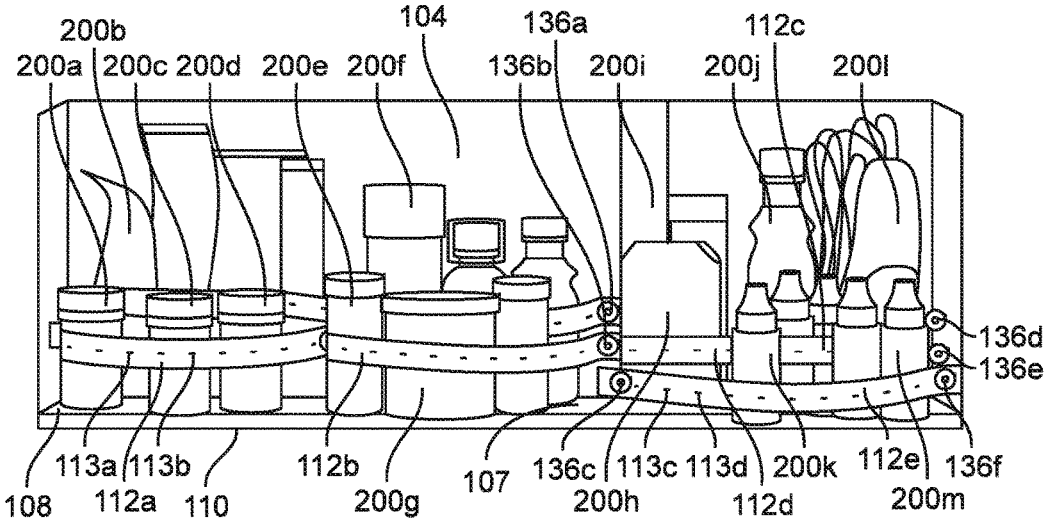
FIG. 2 illustrates a perspective view of a double tiered adjustable organizational system shown in FIG. 1, showing the straps for single and multi-tiered cabinets, in accordance with an embodiment of the present invention.
Figure 3:
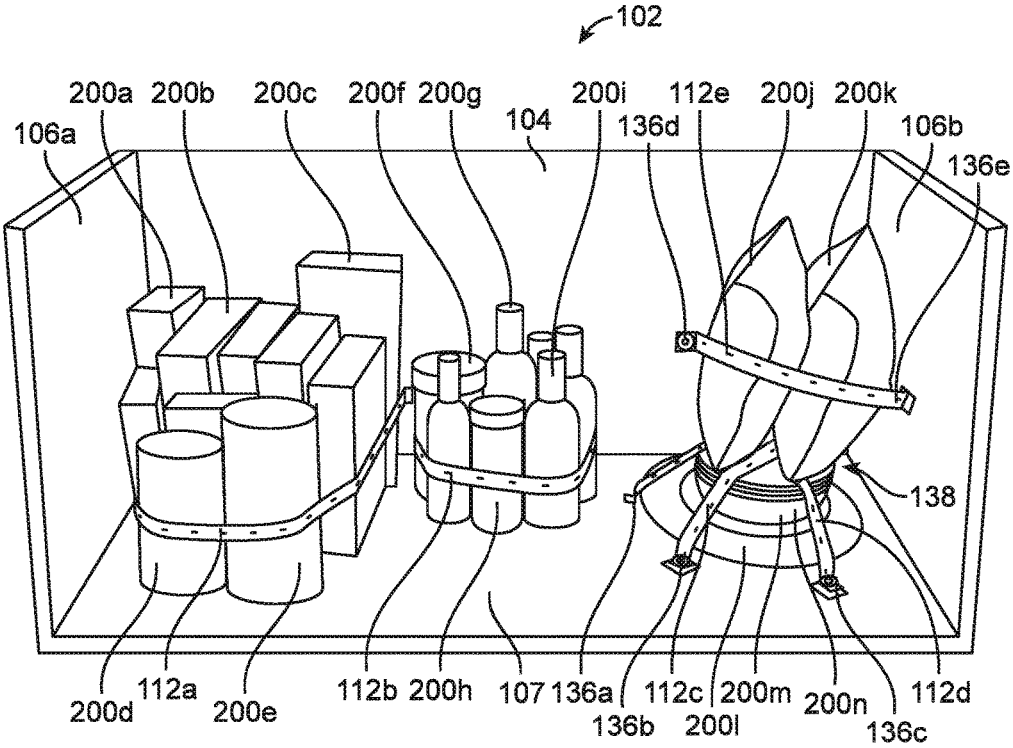
FIG. 3 illustrates a perspective view of the adjustable organizational system, showing the straps restraining items on, both the sidewalls and bottom wall of the cabinet, in accordance with an embodiment of the present invention.

As FIGS. 1-3 reference, system 100 is configured to segregate a plurality of items 200*a-p* into groups inside cabinet 102 with a plurality of flexible, repositionable straps 112*a-f*. In one non-limiting embodiment, system 100 is operable in a cabinet that defined by a frame for protecting and supporting a plurality of items 200*a-p*. Cabinet 102 is defined by a back wall 104, a pair of sidewalls 106*a-b*, and a bottom wall 107.

System 100 further comprises at least one shelf 110 extending between the pair of sidewalls 106*a-b* of the cabinet 102. Shelf 110 may be flat and horizontal. In one non-limiting embodiment, a plurality of holes are formed in the back wall 104 and sidewalls 106*a-b* of cabinet 102. Holes may be disposed in a linear, spaced-apart arrangement to receive fastening mechanisms, and thereby support cabinet.

In one non-limiting embodiment, cabinet 102 may include, without limitation, a medicine cabinet, a tool cabinet, a storage section of a recreational vehicle, boats, campers, any type of moving vehicle with shelving or flat surface 108, a medical instrumentation cabinet, a storage shed, and a refrigeration unit. Though in other embodiments, cabinet 102 may include any type of cabinet containing any type of items 200*a-p* that are supported on shelves. Items 200*a-p* contained in the cabinet 102 may include, without limitation, hygiene products 200*a*, medicine containers 200*b*, shaving products 200*c*, automobile tools 200*d*, first aid equipment 200*e*, a tool 200*f*, wiring 200*g*, and a food item 200*h*.

In one non-limiting embodiment, at least one shelf 110, or multiple configurations of the bottom wall 107, are disposed in a stacked arrangement and extending between the pair of sidewalls 106*a-b*. Shelf 110 supports the items 200*a-p* and enable items to be grouped in a desired arrangement in cabinet 102. The groupings of items can be rearranged to achieve a desired organizational configuration on each shelf 110. System 100 allows further segregation of items within each bottom wall 107, or shelf 110, as described below. Shelves 110 are configured to support the items 200*a-p*.

In one non-limiting embodiment, system 100 further comprises a plurality of straps 112*a-f* that are defined by at least one slot 113*a-d* and a pair of free ends 114*a*, 114*b*. Straps 112*a-f* are sized and dimensioned to extend across the back wall 104, sidewalls 106*a-b*, and bottom wall 107 of cabinet 102. Straps 112*a-f* are defined by a generally flat, resilient configuration that allows for extension and retraction of straps 112*a-f* relative to back wall 104, sidewalls 106*a-b*, and bottom wall 107 of cabinet 102.

In this manner, the straps 112*a-f* help retain items 200*a-p* along the back wall 104, the sidewalls 106*a-b*, and the bottom wall 107 of cabinet 102. The slots 113*a-d* that form through straps 112*a-f* are disposed in a linear, spaced-apart relationship, which helps enhance the resiliency of the straps 112*a-f*. By stretching in this manner, the straps 112*a-f* apply tension to the items 200*a-p*, which secures the items against the cabinet walls 104, 106*a-b*, 107.

In one non-limiting embodiment, straps 112*a-f* may include a slotted, two-sided foam tape. Though any stretchable, elongated restraining member may be used. Straps 112*a-f* may have different lengths and widths, depending on the parameters of cabinet walls 104, 106*a-b*, 107 and shelf 110. As straps 112*a-f* extends across cabinet walls 104, 106*a-b*, 107, a gap 138 forms between strap 112*a*, and back wall 104, sidewalls 106*a-b*, or bottom wall 107 of cabinet 102. Gap 138 provides the necessary space to enable placement of items 200*a-p* between the walls 104, 106*a-b*, 107 and strap 112*a-f*. Gap 138 may be increased or decreased through manipulation of a plurality of strap adjustment members 136*a-f* that fasten and adjust length of strap against cabinet walls 104, 106*a-b*, 107, as described below.

FIG. 1 illustrates system 100 for single and multi-tiered cabinets. In this example, four groups of items 200*b*, 200*c*, 200*d*, 200*e*, 200*f*, 200*g*, 200*h*, 200*i*, 200*j*, 200*k*, 200*k*, 200*l*, 200*m*, 200*n* are restrained against back wall 104, and two groups of items 200*a*, 200*p* are restrained against each sidewall 106*a*, 106*b*. Each group of items 200*a-p* may be removed from the cabinet 102 by detaching the accompanying strap adjustment members 136*a-f* from the back wall 104.

FIG. 2 illustrates system 100, showing the straps 112*a-f* for single and multi-tiered cabinets. In this example, three groups of items are restrained against back wall 104, with a smaller group of items being restrained inside a larger group of items through use of overlapping straps 112*a-f*. Each group of items may be removed from the cabinet by detaching the accompanying strap adjustment members from the back wall 104 and sidewalls 106*a-b*.

FIG. 3 illustrates system 100, showing the straps 112*a-f* arranged to restrain items 200*a-p* on, both the sidewalls 106*a-b* and bottom wall 107 of the cabinet 102. In this example, a grouping of plates 200*l*, 200*m*, 200*n* is retained by straps 112*c*, 112*d* on bottom wall 107; a first group of food items 200*a-e* is retrained on back wall 104; and a second group of food items 200*f-i* is also restrained against back wall 104.

Figure 5A:
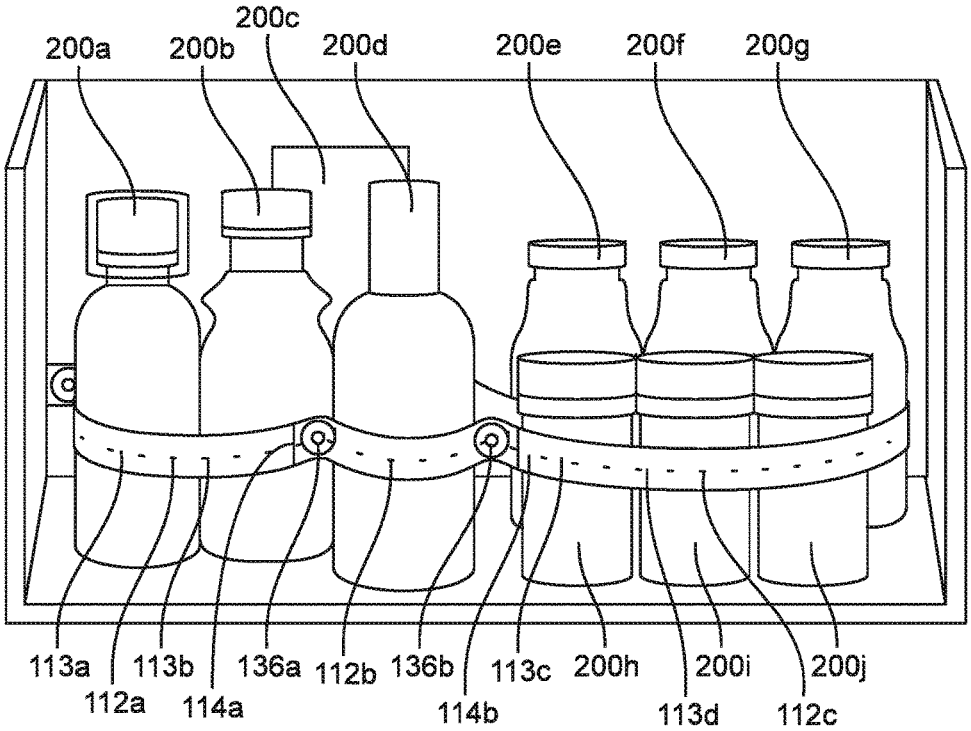
FIGS. 5A and 5B illustrate perspective views of the organizational system and strap adjustment member with a connector stud, where

In yet another example of grouping items, FIG. 5A references three groups of items 200*a-j*, with a first group of items and a second group of items being restrained against a back wall 104, while the third group of items provides a strap 112*b* that attaches to the other two straps 112*a*, 112*c* at its free ends 114*a*, 114*b* to restrain a single item 200*d*. The third group of items 200*d* may be removed from the first two groups by detaching the accompanying strap adjustment members 136*a*, 136*b*.

Figure 4A:
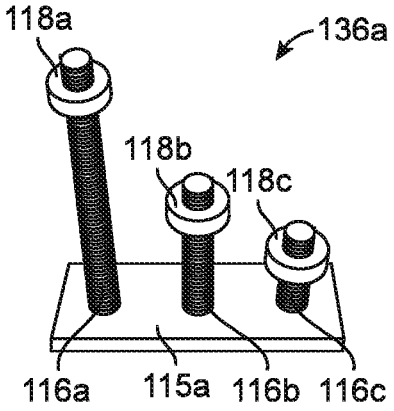
FIGS. 4A, 4B, 4C, and 4D illustrate perspective views of exemplary strap adjustment members, where
Figure 4B:
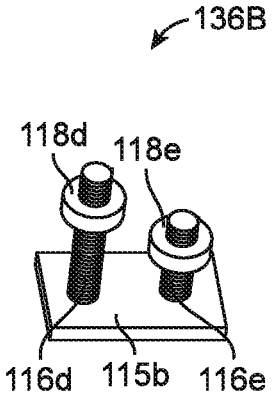
Figure 4C:
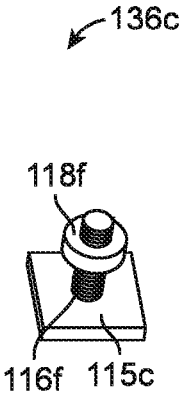

Turning now to FIGS. 4A, 4B, and 4C, system 100 further provides a plurality of strap adjustment members 136*a-f* for adjusting the length and position of straps 112*a-f* relative to cabinet walls 104, 106*a-b*, 107. Strap adjustment members 136*a-f* are configured to detachably fasten the free ends 114*a*, 114*b* of straps 112*a-f* together. Strap adjustment members 136*a-f* are further configured to detachably fasten free ends 114*a-b* of the straps 112*a-f* to the back wall 104, the sidewalls 106*a-b*, and the bottom wall 107 of the cabinet 102.

Strap adjustment members 136*a-f* comprise a side mounting block 115*a-c*, a stud 116*a-f*, and a retaining nut 118*a-f*. In one non-limiting embodiment, strap adjusting members 136*a-f* comprises a fixed threaded bolt and adjustable nuts. In one non-limiting embodiment, stud 116*a-f* is a threaded bolt, or a ¼"-20 thread ½" long threaded screw, and nut 118*a-f* is a circular ½" O.D. w/¼-20 internal threads approximately ⅛" thick retaining nut. In yet other non-limiting embodiments, mounting block 115*a-c* may have a generally square shape when single tiered, and rectangular shaped for double and triple tiered.

Figure 4D:
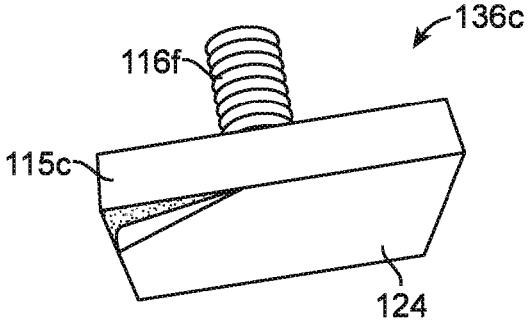

As discussed above, strap adjustment members 136*a-f* are configured to pass through the free ends 114*a-b* of straps 112*a-f* for detachable coupling to cabinet walls, so as to fasten the free end 114*a-b* of the straps 112*a-f* to the back wall 104 or the pair of sidewalls 106*a-b*, or bottom wall 107 of cabinet 102. Strap adjustment members 136*a-f* are configured to extend and retract in height relative to cabinet walls 104, 106*a-b*, 107. This height adjustability enables repositioning and length adjustment of straps 112*a-f* relative to cabinet walls 104, 106*a-b*, 107. Mounting block 115*a-c* of strap adjustment members are secured anywhere desired to the cabinet walls 104, 106*a-b*, 107 through use of a two-sided adhesive 124, as shown in FIG. 4D.

In one embodiment, detachably mating the strap adjustment members 136*a-f* with mounting blocks 115*a-c* causes the strap 112*a-f* to reposition to different locations along the back wall 104, sidewalls 106*a-b*, or bottom wall 107 of cabinet 102. Further, extending and retracting strap adjustment member 136*a-f* changes the size of the gap 138 between the straps 112*a-f* and cabinet walls 104, 106*a-b*, 107. This is because free ends 114*a-b* of strap 112*a-f* are moved further away from cabinet walls 104, 106*a-b*, 107 when the strap adjustment member 136*a-f* is extended, and moved closer to cabinet walls 104, 106*a-b*, 107 when strap adjustment member 136*a-f* is retracted.

Figure 5B:
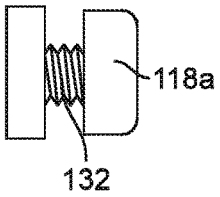

FIG. 5A references three groups of items 200*a-j*, with a first group of items and a second group of items being restrained against a back wall 104, while the third group of items provides a strap 112*b* that attaches to the other two straps 112*a*, 112*c* at its free ends 114*a*, 114*b* to restrain a single item 200*d*. The third group of items 200*d* may be removed from the first two groups by detaching the accompanying strap adjustment members 136*a*, 136*b*. FIG. 5B illustrates a connector stud 132 that can be used to manipulate nut 118*a-f* against walls of cabinet in this manner.

In operation of strap adjustment members, nut 118*a*, 118*b*, 118*c*, 118*d*, 118*e*, 118*f* is rotatably displaced along the length of stud 116*a-f* to adjust the length of the straps 112*a-f*. Both nut 118*a-f* and stud 116*a-f* may be threaded to assist in this function. Thus, rotating the nut 118*a-f* relative to the side mounting block adjusts the length and position of strap, so that a gap 138 forms between strap 112*a-f* and back wall 104, sidewalls 106*a-b*, and bottom wall 107 of cabinet 102. Gap 138 allows for placement of items between walls and straps 112*a-f*. For example, rotating nut 118*a* in a first direction relative to stud 116*a* increases the size of gap 138, while rotating nut 118*a* in a second direction relative to stud 116*a* decreases the size of the gap 138.

System 100 provides various configurations, due to the detachable fastening capacity of the straps 112*a* relative to adjacent straps 112*b* and cabinet walls 104, 106*a-b*, 107. This can be especially useful for retaining items having different sizes and shapes. For example, strap adjustment members 136*a*, 136*b* on each side of a first strap 112*a* can be moved along the linear arrangement of holes to accommodate various sizes and shapes of items 200*a-d*. First strap is set at a first tier based on the height of the strap adjustment members. Here, height restraining members are fully retracted to enable the strap to restrain a couple of adjacently disposed small items, e.g., a pill bottle.

Where two coplanar straps 112*a*, 112*b* are used to restrain items 200*a-f*. First strap 112*a* is height adjusted at a first tier based on the height of the strap adjustment members 136*a*, 136*b*. First strap 112*a* restrains a couple of adjacently disposed small items 200*a*, 200*b*. Second strap 112*b*, shown restraining larger items 200*c*, 200*d*, has strap adjustment members 136*c*, 136*d* that are extended further than the first strap adjustment members 136*a*, so as to provide a larger gap for the larger 200*a-f*, e.g., medicine bottles.

As illustrated in FIG. 2, three sets of strap adjustment members 136*a-f* detachably couple to back wall 104. The adjacent position of strap adjustment members on each end of the straps 112*a-f* allows for at least three or four straps to extend along the same length of the shelf. The difference being that the height of strap adjustment members may be different, so as to create variously sized gaps between straps and back wall or sidewalls. This creates a multi-tiered arrangement where items of different sizes and shapes can be grouped separately on the same shelf.

For example, a large shaving cream can 200*f*, a toothpaste tube 200*b*, and a pill bottle 200*c* are organized on the same bottom wall 107, or shelf 110, adjacent to each other. The large items are restrained by a second strap 112*b* having a pair of fully extended third strap adjustment members that form a third tier. This full extension of strap adjustment members relative to the back wall creates a large gap for restraining the relatively large items, e.g., shaving cream can, hair spray can.

Secondly, the toothpaste tube is restrained by a fifth strap 112*d* having a pair of partially extended second strap adjustment members that form a third tier. This partial extension creates a smaller gap for restraining the toothpaste tube. Still looking at FIG. 2, the pill bottle 200*a* is restrained by a first strap 112*a* having a pair of fully retracted first strap adjustment members that form a first tier. This full retraction of strap adjustment members relative to the back wall 104 creates a small gap for restraining the relatively small pill bottle 200*a*.

System 1—Single Tier

In one embodiment as illustrated in FIG. 1, the single tiered version of the system but not limited to a cabinet/shelving/drawer organization system, there are two straps 112*a*, 112*b* in a parallel relationship running coplanar, which are attached to mounting blocks (FIG. 4A) and restrained by retaining nut 118*a*. System 100 presented in FIG. 1 illustrates an exemplary view of sidewalls 106*a-b* of cabinet 102. A collaboration of straps 112*a-f* and strap adjustment members 136*a-f* are configured to segregate a multitude of items 200*a-p* are specific to items illustrated against a sidewall 106*a-b* of an exemplary single tier cabinet/shelving/drawer organization system. In one embodiment, the single tiered version of the cabinet/shelving/drawer organization system, has one or more side straps 112*a-b* attached to mounting blocks 115*a-b*. This side configuration is typically used for smaller items 200*a-c*.

System 2—Double Tier

In one embodiment as illustrated in FIG. 2, the double tiered version of the cabinet/shelving/drawer organization system also has two straps 112*a-f* but, one strap 112*a-f* for each tier for mounting blocks. Strap 112*a-f* holding post/threaded stud 116*b* is adjustable to accommodate various sizes and shapes of items 200*a-p* by use of retaining nuts 118.

In one embodiment of the present invention presented in FIG. 2 illustrates an exemplary view of the double tiered version of cabinet/shelving/drawer organization system. An exemplary of a cabinet 102 consists of a back wall 104, at least one shelf 110 and optional side walls 106*a*, 106*b*. A collaboration of straps 112*a-f*, strap adjustment members 136*a-f*, and mounting block assemblies are configured to segregate at different levels of a multitude of items 200*a-p* not specific to items illustrated on different shelves 110 and then groups and segregates items 200*a-p* on each shelf 110 into size and height-dependent groups through a plurality of mounting block assemblies and straps 112*a-f*.

System 3—Triple Tier

In one embodiment as illustrated in FIG. 3, the triple tiered version of the cabinet/shelving/drawer organization system has three straps 112*a-c*. One strap is used for each tier for strap adjustment members 136*e*, 136*f* in which two straps 112*a-b* on holding post/threaded stud are adjustable to accommodate various sizes and shapes of items 200*a-p* by use of retaining nuts 118*a-b*.

In one embodiment of the present invention presented in FIGS. 3 and 5B illustrates an exemplary view of the triple tiered version of a cabinet/shelving/drawer organization system. An exemplary of a cabinet 102 will consist of a back wall 104, at least one shelf 110 and the optional side walls 106*a-b*. A collaboration of straps 112*a-f*, strap adjustment members 136*a-f*, and mounting block assemblies are configured to segregate items 200*a-p* at different levels of a multitude of items 200*a-p* not specific to items illustrated on different shelves 110 and then groups and segregates items 200*a-p* on each shelf 110 into size and height-dependent groups.

As shown in FIG. 5B, a cabinet 102 comprises a plurality of shelves 110 and can be arranged in a stacked configuration. The segregated items 200*a-p* may be grouped on each shelf 110 into size-dependent groups through a plurality of mounting block assemblies and straps 112*a-f* to enable selective segregation of multiple items 200*a-p* of different heights and sizes on different shelves 110.

In some embodiments, a plurality of straps 112*a-f* longitudinally traverse the shelves 110 and walls 104, 106*a-b*, 107 running coplanar to the back wall 104 or side wall 106*a-b*. Straps 112*a-f* are defined by a pair of free strap ends 114*a*, 114*b* with all straps 112*a-f* being slotted with at least one slot 113*a*, 113*b*, 113*c*, 113*d* that enhances the flexibility of the straps 112*a-f* through multiple configurations and arrangements.

As referenced in FIG. 5B, in all embodiments of any leveled tier, the strap adjustment members 136*a-f*, and mounting block assemblies are secured anywhere desired to the back wall 104 by a two-sided adhesive 124 in which straps 112*a-f* are placed on holding posts/threaded, or studs 116*a*, 116*b*, 116*c*, 116*d*, 116*e*, 116*f* using any desired slot and restrained by adjustable retaining/tensioner nuts 118*a-f*. In an embodiment usage of the sidewall 106*a*, the side mounting blocks 115*a*, 115*b*, 115*c* are secured to a side wall 106*a-b* by a two-sided adhesive 124 in which straps 112*a-f* are placed onto holding posts/threaded stud 116*a* using both strap ends 114*a-b* and restrained by retaining nuts 118*a-f*.

As illustrated in FIG. 5B, mounting blocks 115*a-c* have holding posts/threaded studs 116*a-f* in which straps 112*a-f* are place over desired slots 113*a-d* in strap 112*a-f* and made adjustable by loosening or tightening adjustable retaining/tensioner nuts 118*a-f*. The ability of the depth adjustment is to accommodate various sizes and dimensions while securing items 200*a-p*. This flexibility also allows adjustments according to the removal on an item 200*a-p*.

For example, a vitamin bottle is empty and removed from a grouping of items. One can easily rotate the retaining nut 118*a* clockwise drawing the strap 112*a* tighter to reduce or eliminate a voided space and maintain the securing of the items 200*a-c*. And to reverse adjustments to allow for an item 200*a-c* when replenished, or replaced by a slightly bigger item 200*d*, the retaining nut 118*a* can be turned counter-clockwise to create more space to accommodate another or larger item 200*d*. If the gap between the strap 112*a* and walls 104, 106*a-b*, 107 be too large, the strap 112*a* may be adjusted and repositioned to another slot until the size of the gap is reduced. The expansion pocket provides a tool for securing the items 200*a-p* utilizing the entire space on the shelf.

As referenced in FIG. 1 the single tiered version, FIG. 2, the double tiered version, and FIG. 3 the triple tiered version of a cabinet/shelving/drawer organization system segregates a plurality of items 200*a-p* into different compartments of cabinet 102, and then groups the segregated hygiene items 200*a-p* not specific to items illustrated with a flexible strap 112*a-f*. In one embodiment, the organization system is operable in a cabinet 102 that comprises a frame. Cabinet 102 may be defined by a back wall 104, a pair of sidewalls 106, and bottom wall 107 that form a generally rectangular shape.

Cabinet 102 may include, but is not limited to, a medicine cabinet, a to cabinet, a medical instrumentation cabinet, and any cabinet, a storage shed, recreational vehicles, boats, campers, and any type of moving vehicle with shelving or a flat surface and a refrigeration unit. Though in other embodiments, the cabinet 102 may include any type of cabinet containing any type of items that are supported on shelves. Items 200*a-p* contained in the cabinet 102 may include, without limitation, hygiene products, medicine containers, shaving products, automobile tools, and a first aid equipment.

In some embodiments, pluralities of shelves 110 are disposed in a stacked arrangement and extending between the pair of sidewalls 106. Shelves 110 support the items 200*a-p* and enable items 200*a-p* to be grouped in a desired arrangement in cabinet 102. The groupings of items 200*a-p* can be rearranged to achieve a desired organizational configuration on each shelf 110. The organization system allows further segregation of items 200*a-p* within each shelf 110, as described below.

Turning now to FIGS. 1-3, the organization systems comprise a plurality of straps 112*a-f* used to retrain the items 200*a-p* on the back wall 104, sidewalls 106*a-b*, and bottom wall 107 of the cabinet 102. Straps 112*a-f* are defined by a pair of free ends 114*a*, 114*b* and a generally resilient longitudinal body. Straps 112*a-f* may be elastic and slotted. Though any stretchable, elongated restraining member may be used. Straps 112*a-f* may have different lengths and widths, depending on the parameters of the shelves 110 and items 200*a-p* contained on the shelves 110.

In one embodiment FIG. 1, straps 112*a-f* extend across the back wall 104 or the pair of sidewalls 106 in a generally parallel disposition. As straps 112*a-f* extend across the back wall 104 or sidewalls 106, at least one gap 138 forms between straps 112*a-f*, and back wall 104 or sidewalls 106 or horizontally on a flat surface 108 of the base of the shelf 110. The gap 138 provides the necessary space to enable placement of items 200*a-p* between the cabinet walls 104, 106*a-b*, 107 and straps 112*a-f*.

As shown in FIG. 3, strap adjustment member 136*a-f* is placed on the holding posts/threaded studs 116*b*, 116*c* as part of mounting block assemblies are configured to pass through the free ends 114*a-b* and slots 113*a*, 113*b*, 113*c*, 113*d* of straps 112*a-f*. In this manner, the holding posts/threaded studs 116*b*, 116*c* are mated with the plurality of slots in straps 112*a-f*, and restrained by retaining nuts 118*a-f* so as to fasten the pair of free end of the straps 112*a-f* in alignment with a respective hole. The holding posts/threaded studs 116*b*, 116*c* are configured to extend in height to allow for the adjustability by rotating the retaining nuts 118*a-f* either clockwise or counter clockwise to insure the securing of items 200*a-p*.

In some embodiments, detaching the adjustable retaining nuts 118*a-f* from the holding posts/threaded studs 116*b*, 116*c* and mating the corresponding desired slots in straps 112*a-f* causes the straps 112*a-f* to reposition to different locations along the back walls 104 mounting block assemblies. Further, extending and retracting depth adjusting retaining nuts 118*a-f* changes the size of the gap 138 between straps 112*a-f*. This is because the strap ends 114*a-b* or any other slot 113*a-d* in straps 112*a-f* are moved further away from or closer to back wall 104 of cabinet 102.

Strap adjustment members 136*a*, 136*b*, 136*c* enable rotatable adjustment of nut 118*a-f* relative to the stud 116*a-f*, so as to create a gap 138 between the straps 112*a-f* and cabinet walls 104, 106*a-b*, 107. Gap 138 is depth adjustable to enable adjustable retention of items 200*a-p* against cabinet walls 104, 106*a-b*, 107. This allows to open or close the gap 138 between the strap 112*a-f* and back wall to accommodate size-dependent items 200.

For example, decreasing the gap between the back wall 104 and the strap 112*a* allows the placement of either larger or smaller items 200*a-b*. Extending the adjusting retainer nuts 118*a* away from the back wall 104 increases the size of the gap 138, while retracting the adjustable retaining nuts 118*a* it decreases the size of the gap 138 between strap 112*a* and cabinet walls 104, 106*a-b*, 107.

FIG. 3 illustrates another embodiment, where three coplanar straps 112*a-c* are used to restrain the items 200*a-j*. First strap 112*a* at a first tier based on the length of holding post/threaded stud 116*b* restrained by retainer nuts 118*a-f* restrains a couple of adjacently disposed taller items 200. And the second strap 112*b* at the second tier based on the length of holding post/threaded stud 116*c* restrained by retainer nuts 118*c* restrains a couple of adjacently disposed medium sized items 200*e-j*.

The third strap 112*c* at a third tier based on the length of holding post/threaded stud 116*c* restrained by retainer nuts 118*c* restrains a couple of adjacently disposed smaller sized items 200*k-p*. The second and third straps 112*b*, 112*c* are adjustable by extending or retracting adjustable retaining nuts 118*b-c* further from or closer to the back wall 104 to provide a larger gap for the larger items 200*a*, a medium sized gap for medium sized items 200*b*, or a smaller gap for smaller items 200*b* e.g., a shaver being the larger item 200*a*, deodorant being the medium sized item 200*c*, and a bottle of nail polish being the smaller item 200*b*.

For example, a large shaving cream can, a toothpaste tube, and a pill bottle are organized on the same shelf 110, adjacent to each other. The large items are restrained by a first strap 112*a-f*. The medium sized items 200*a-p* are restrained by a second strap 112*a-f* and smaller items 200*a-p* are restrained by a third strap 112*a-f*. This full extension of length of holding post/threaded studs 116*b*, 116*c* in relation to the back wall 104 creates a large gap for restraining the relatively large items 200*e*, 200*f*, e.g., shaving cream can, hair spray can.

Secondly, the toothpaste tube is restrained by a second strap 112*b* having a pair of partially extended second adjustable retaining nut 118*b* on holding post/threaded stud 116*b* that form a second tier. This partial extension creates a smaller gap for restraining the toothpaste tube. Finally, the pill bottle is restrained by a third strap 112*c* and secured to holding post/threaded stud 116*c* being restrained by adjustable nuts 118*a-f* having a pair of fully retracted length adjusted, that form the third tier. This full retraction minimizing clearance from the back wall 104, creates a small gap for restraining the relatively medium and small pill bottle.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An adjustable organizational system for organizing items in a cabinet, the system comprising:

a cabinet defined by a back wall, a pair of sidewalls, and a bottom wall;

a plurality of straps defined by at least one slot and a pair of free ends, the straps extending across the back wall, the pair of sidewalls, and the bottom wall, the straps further being defined by a resilient configuration enabling extension and retraction of the straps relative to the back wall, the sidewalls, and the bottom wall, whereby the at least one slot enhances the resiliency of the straps, whereby the straps help retain at least one item along the back wall, the sidewalls, and the bottom wall of the cabinet; and a plurality of strap adjustment members comprising a side mounting block, a stud, and a nut, the strap adjustment members detachably fastening the free ends of the straps together, the strap adjustment members further detachably fastening the free ends of the straps to the back wall, the sidewalls, and the bottom wall of the cabinet, whereby the nut is rotatably displaced along the length of the stud to adjust the length of the straps.

2. The system of claim 1, wherein the at least one slot is a plurality of slots in the straps disposed in a linear, spaced-apart relationship.

3. The system of claim 1, wherein the straps are generally resilient and flat.

4. The system of claim 1, wherein the straps extend across the back wall, the pair of sidewalls, and the bottom wall in a generally parallel disposition.

5. The system of claim 1, wherein two strap adjustment members couple adjacently to each other on a free end of three straps or any slots formed in the free ends of the straps.

6. The system of claim 1, wherein the stud comprises a fixed threaded stud.

7. The system of claim 1, wherein the nut is an adjustable nut.

8. The system of claim 1, wherein rotating the nut relative to the side mounting block creates a gap between the straps and the back wall, the sidewalls, and the bottom wall of the cabinet.

9. The system of claim 1, wherein the bottom wall comprises at least one shelf extending between the pair of sidewalls of the cabinet.

10. The system of claim 9, wherein the at least one shelf comprises a horizontal flat surface.

11. The system of claim 10, wherein the at least one shelf is arranged in a single tier configuration, or a double tier configuration, or a triple tier configuration.

12. The system of claim 11, wherein the system further comprises a connector stud and an expansion pocket.

13. The system of claim 12, wherein the mounting block of the strap adjustment members comprise a two-sided adhesive.

14. The system of claim 1, wherein the cabinet includes at least one of the following: a recreational vehicle cabinet, a medicine cabinet, and a kitchen cabinet.

15. The system of claim 1, wherein the straps retain a plurality of items against the back wall, the sidewalls, and the bottom wall of the cabinet.

16. The system of claim 15, wherein the plurality of items includes at least one of the following: a hygiene container, a medicine container, a shaving device, an electrical device, a tool, wiring, and a food item.

17. An adjustable organizational system for organizing items in a cabinet, the system consisting of:

a cabinet defined by a back wall, a pair of sidewalls, and a bottom wall;

at least one shelf extending between the pair of sidewalls of the cabinet;

a plurality of straps defined by at least one slot and a pair of free ends, the at least one slot disposed in a linear, spaced-apart relationship, the straps extending across the back wall, the pair of sidewalls, and the bottom wall, the straps further being defined by a resilient configuration enabling extension and retraction of the straps relative to the back wall, the sidewalls, and the bottom wall, whereby the at least one slot enhances the resiliency of the straps, whereby the straps help retain at least one item along the back wall, the sidewalls, and the bottom wall of the cabinet; and a plurality of strap adjustment members comprising a side mounting block, a stud, and a nut, the strap adjustment members detachably fastening the free ends of the straps together, the strap adjustment members further detachably fastening the free ends of the straps to the back wall, the sidewalls, and the bottom wall of the cabinet, whereby the nut is rotatably displaced along the length of the stud to adjust the length of the straps, whereby rotating the nut relative to the side mounting block creates a gap between the straps and the back wall, the sidewalls, and the bottom wall of the cabinet.

18. The system of claim 17, wherein the bottom wall comprises at least one shelf extending between the pair of sidewalls of the cabinet, the at least one shelf of the bottom wall defined by a horizontal flat surface.

19. The system of claim 17, wherein the at least one shelf is arranged in a single tier, a double tier, or a triple tier configuration.

* * * * *